US008127371B2

(12) United States Patent
Kelley

(10) Patent No.: US 8,127,371 B2
(45) Date of Patent: Mar. 6, 2012

(54) TIE STAY CLIPS AND METHODS OF MAKING AND USING THE SAME

(76) Inventor: Glen Kelley, Niceville, FL (US)

( * ) Notice: Subject to any disclaimer, the term of this patent is extended or adjusted under 35 U.S.C. 154(b) by 969 days.

(21) Appl. No.: 12/117,141

(22) Filed: May 8, 2008

(65) Prior Publication Data

US 2009/0276980 A1 Nov. 12, 2009

(51) Int. Cl.
*A41D 25/00* (2006.01)

(52) U.S. Cl. ..... 2/145; 24/66.4; 24/66.8

(58) Field of Classification Search ..... 24/66.4
See application file for complete search history.

(56) References Cited

U.S. PATENT DOCUMENTS

| | | | | | |
|---|---|---|---|---|---|
| 2,210,275 | A | * | 8/1940 | Bertling | 24/66.8 |
| 2,592,395 | A | * | 4/1952 | Cummings | 24/66.1 |
| 2,601,424 | A | * | 6/1952 | Baker | 24/66.1 |
| 5,267,374 | A | * | 12/1993 | Drake | 24/30.5 R |
| 5,375,301 | A | | 12/1994 | Schindler | |
| 5,414,908 | A | | 5/1995 | Haines | |

* cited by examiner

*Primary Examiner* — Jack W. Lavinder
(74) *Attorney, Agent, or Firm* — Withers & Keys, LLC

(57) ABSTRACT

Tie stay clips are disclosed. Methods of making and using tie stay clips are also disclosed.

15 Claims, 6 Drawing Sheets

TIE STAY CLIPS AND METHODS OF MAKING AND USING THE SAME

TECHNICAL FIELD

The present invention relates to tie stay clips. The present invention further relates to methods of making and using tie stay clips.

BACKGROUND OF THE INVENTION

When properly affixed around a person's neck, a traditional tie comprises (i) a front tie portion positioned furthest away from the chest of the person and (ii) a rear tie portion positioned between the front tie portion and the chest of the person. Many ties have a loop on a rear surface of the front tie portion so that a tail end of the rear tie portion can be inserted through the loop for securing the rear tie portion to the front tie portion. Unfortunately, the loop on the rear surface of the front tie portion of traditional ties can become unattached from the rear surface of the front tie portion due to improper stitching, or some other tie defect. When this happens, the rear tie portion moves uncontrollably from behind the front tie portion so as to be undesirably in view along with the desirably view of the front surface of the front tie portion. In addition, due to (i) the length of the tie, (ii) the height of the person wearing the tie, or (iii) both (i) and (ii), the rear tie portion is not long enough to extend through the loop on the rear surface of the front tie portion when the tie is properly affixed around a person's neck, and consequently, moves uncontrollably from behind the front tie portion so as to be undesirably in view.

What is needed in the art is a simple tie stay clip and method of using a simple tie stay clip that prevents a rear tie portion from moving uncontrollably from behind a front tie portion so as to be undesirably in view.

SUMMARY OF THE INVENTION

The present invention is directed to tie stay clips that are capable of securing a rear portion of a tie behind a front portion of a tie so as to prevent the rear portion of the tie from moving uncontrollably from behind the front portion of the tie and in view. The present invention is further directed to methods of using tie stay clips. In one exemplary embodiment, the method of using a tie stay clip comprises clamping a rear portion of a tie to a front portion of a tie via the tie stay clip so that a portion of a front surface of the rear portion of the tie is temporarily secured to and held adjacent to a portion of a rear surface of the front portion of the tie.

In a further exemplary embodiment, the method of using a tie stay clip comprises a method of securing a rear portion of a tie to a rear surface of a front portion of a tie, wherein the method comprises (I) providing a tie stay clip having an uppermost outer major surface and a lowermost outer major surface, wherein the tie stay clip comprises (i) a first member forming the uppermost outer major surface and having a first member first end and a first member second end opposite the first member first end, (ii) a second member pivotably connected to the first member along a length of the first member between the first member first and second ends, the second member forming the lowermost outer major surface and having second member first end and a second member second end opposite the second member first end, and (iii) a spring member positioned between the first and second members, the spring member being operatively adapted to apply a spring pressure onto the first and second members so as to force an inner surface of the first member second end toward an inner surface of the second member second end; (II) applying pressure onto at least one of the first member first end and the second member first end so as to separate the inner surface of the first member second end from the inner surface of the second member second end and form a gap therebetween; (III) positioning (i) the rear portion of the tie and (ii) a vertically extending seam portion of the front portion of the tie within the gap; and (IV) releasing the pressure on the first member first end or the second member second end so as to allow the inner surface of the first member second end and the inner surface of the second member second end to move towards one another and clamp therebetween (i) a portion of the rear portion of the tie and (ii) a portion of the vertically extending seam portion of the front portion of the tie so as to temporarily secure the rear portion of the tie to the rear surface of the front portion of the tie.

The present invention is further directed to a combination of a tie and a tie stay clip. In one exemplary embodiment, the combination comprises a tie and a tie stay clip, wherein the tie stay clip comprises a first member forming an uppermost outer major surface of the tie stay clip and having a first member first end and a first member second end; a second member pivotably connected to the first member along a length of the first member between the first member first and second ends, the second member forming a lowermost outer major surface of the tie stay clip and having a second member first end and a second member second end; and a spring member positioned between the first and second members, the spring member being operatively adapted to apply a spring pressure onto the first and second members so as to force an inner surface of the first member second end toward an inner surface of the second member second end.

The present invention is further directed to methods of making tie stay clips. In one exemplary embodiment, the method of making a tie stay clip comprises forming a first member having a first member first end and a first member second end; forming a second member having a second member first end and a second member second end; positioning a spring member between the first and second members; and pivotably connecting the first member to the second member along a length of the first member between the first member first and second ends, wherein the spring member is operatively adapted to apply a spring pressure onto the first and second members so as to force an inner surface of the first member second end toward an inner surface of the second member second end.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

Figure 1A:
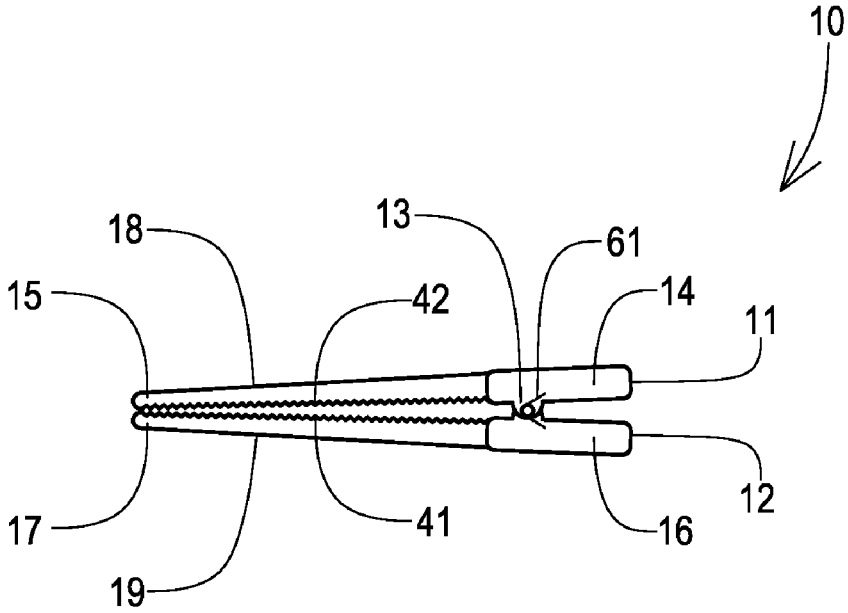
FIG. 1A provides a side view of an exemplary tie stay clip of the present invention.

The present invention is directed to tie stay clips suitable for securing a rear portion of a tie to a front portion of the tie. One exemplary tie stay clip of the present invention is shown as exemplary tie stay clip 10 in FIG. 1A.

Referring to FIG. 1, exemplary tie stay clip 10 comprises a first member 11 forming an uppermost outer major surface 18 and having a first member first end 14 and a first member second end 15 opposite first member first end 14; and a second member 12 pivotably connected to first member 11 along a length of first member 11 between first member first and second ends 14 and 15 respectively. Second member 12 forms a lowermost outer major surface 19 and has a second member first end 16 and a second member second end 17 opposite second member first end 16. Exemplary tie stay clip 10 further comprises a spring member 61 (shown (i) as dashed lines 61 within exemplary tie stay clip 10 and (ii) separate from exemplary tie stay clip 10) positioned between first and second members 11 and 12, spring member 61 being operatively adapted to apply a spring pressure onto first and second members 11 and 12 so as to force an inner surface 42 of first member second end 15 toward an inner surface 41 of second member second end 17.

As used herein, the term "spring member" is used to describe any spring, such as a torsion spring, or any other member that is operatively adapted to apply a spring pressure onto first and second members 11 and 12 so as to force inner surface 42 of first member second end 15 toward inner surface 41 of second member second end 17.

Figure 1B:
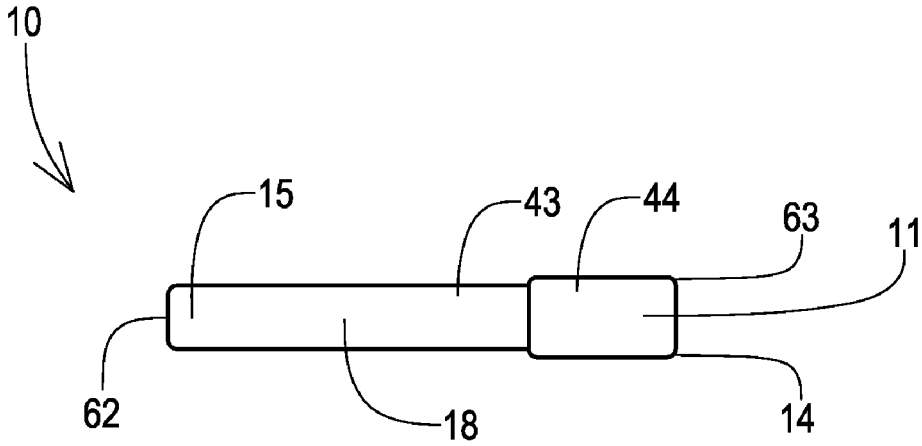
FIG. 1B provides a top view of the exemplary tie stay clip shown in FIG. 1A along with optional attachment members for the exemplary tie stay clip.

FIG. 1B provides a top view of exemplary tie stay clip 10 along with optional attachment members capable of being used with exemplary tie stay clip 10. As shown in FIG. 1B, exemplary tie stay clip 10 comprises first member 11, uppermost outer major surface 18, first member first end 14 and first member second end 15 opposite first member first end 14. Exemplary tie stay clip 10 further comprises a first outermost surface portion 43 of uppermost outer major surface 18 extending from (i) a location proximate a connection point 13 (see connection point 13 shown in FIG. 1A) between first member 11 and second member 12 to (ii) a tip 62 of first member second end 15. Exemplary tie stay clip 10 further comprises a second outermost surface portion 44 of uppermost outer major surface 18 extending from (i) a location proximate a connection point 13 (see connection point 13 shown in FIG. 1A) between first member 11 and second member 12 to (ii) a tip 63 of first member first end 14.

In some exemplary embodiments, first outermost surface portion 43 of uppermost outer major surface 18, second outermost surface portion 44 of uppermost outer major surface 18, or both first outermost surface portion 43 and second outermost surface portion 44 may comprises (1) indicia (e.g., printed text or symbols), (2) valleys therein, (3) peaks thereon, or (4) any combination of (1) to (3) (not shown). Such valleys, peaks, or combinations thereof may provide, for example, indicia, a decorative emblem, or an identification of the clip owner.

In other exemplary embodiments, first outermost surface portion 43 of uppermost outer major surface 18, second outermost surface portion 44 of uppermost outer major surface 18, or both first outermost surface portion 43 and second outermost surface portion 44 provide one or more surfaces on which one or more attachment members 45 and 46 may be placed. Exemplary attachment members 45 and 46 are each independently sized to fit within an outer periphery of first outermost surface portion 43 or second outermost surface portion 44. Each of exemplary attachment members 45 and 46 may be attachable to first outermost surface portion 43 or second outermost surface portion 44. In one exemplary embodiment, one or more attachment members (e.g., exemplary attachment members 45 and 46) are temporarily attachable to first outermost surface portion 43 or second outermost surface portion 44 via a temporary bonding agent (e.g., magnetism, a repositionable adhesive, etc.).

In other exemplary embodiments, one or more attachment members (e.g., exemplary attachment members 45 and 46) are permanently attached to first outermost surface portion 43 or second outermost surface portion 44 via a permanent bond (e.g., an adhesive or mechanical bond such as a weld). As used herein, permanent attachment and permanent bond are used to describe embodiments in which the one or more attachment members (e.g., exemplary attachment members 45 and 46) are designed to remain fixed on first outermost surface portion 43 or second outermost surface portion 44 during the lifetime of exemplary tie stay clip 10 (even though it may be possible to remove the one or more attachment members by brute force, such as by breaking a weld or destroying the cohesive strength of an adhesive layer).

Although not shown in the figures, each of the one or more attachment members (e.g., exemplary attachment members 45 and 46) may comprises (1) indicia (e.g., printed text or symbols), (2) valleys therein, (3) peaks thereon, or (4) any combination of (1) to (3) (not shown). Such valleys, peaks, or combinations thereof may provide, for example, indicia, a decorative emblem, or an identification of the clip owner.

Figure 1C:
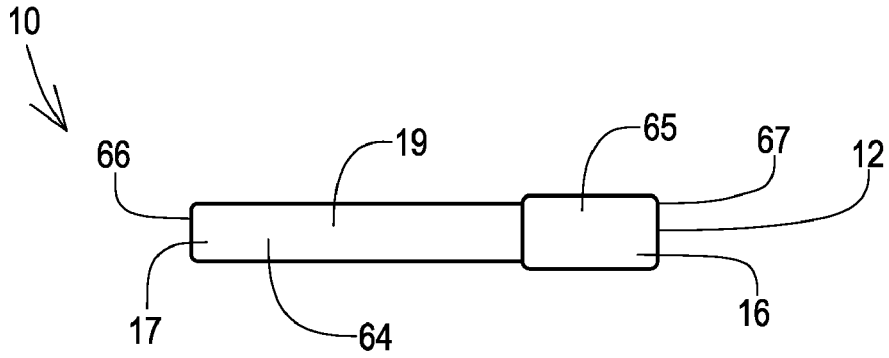
FIG. 1C provides a bottom view of the exemplary tie stay clip shown in FIG. 1A.

FIG. 1C provides a bottom view of exemplary tie stay clip 10. As shown in FIG. 1C, exemplary tie stay clip 10 comprises second member 12, lowermost outer major surface 19, second member first end 16 and second member second end 17 opposite second member first end 16. Exemplary tie stay clip 10 further comprises a first outermost surface portion 64 of lowermost outer major surface 19 extending from (i) a location proximate a connection point 13 (see connection point 13 shown in FIG. 1A) between first member 11 and second member 12 to (ii) a tip 66 of second member second end 17. Exemplary tie stay clip 10 further comprises a second outermost surface portion 65 of lowermost outer major surface 19 extending from (i) a location proximate a connection point 13 (see connection point 13 shown in FIG. 1A) between first member 11 and second member 12 to (ii) a tip 67 of second member first end 16.

Although not shown in FIG. 1C, it should be understood that first outermost surface portion 64 of lowermost outer major surface 19, second outermost surface portion 65 of lowermost outer major surface 19, or both first outermost surface portion 64 and second outermost surface portion 65 may comprise (1) indicia (e.g., printed text or symbols), (2) valleys therein, (3) peaks thereon, or (4) any combination of (1) to (3) (not shown) as described above. Further, although not shown in FIG. 1C, it should be understood that one or more attachment members (e.g., exemplary attachment members 45 and 46) may be temporarily or permanently attached to first outermost surface portion 64 or second outermost surface portion 65 as discussed above.

Figure 1D:
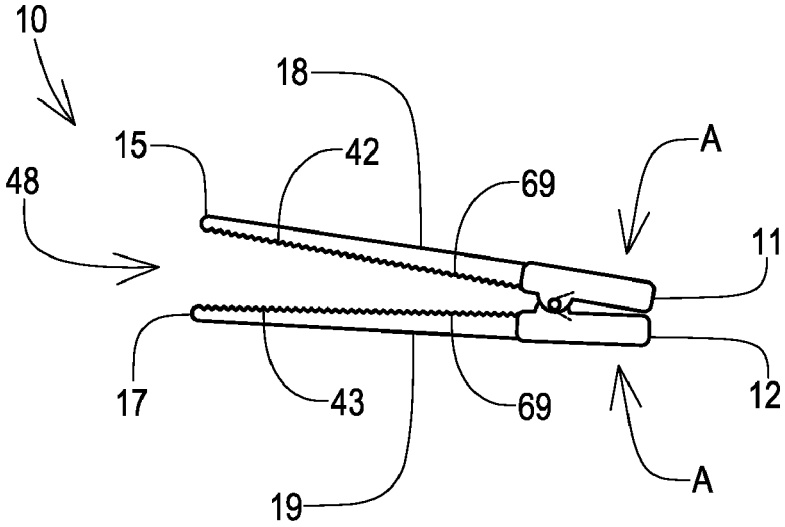
FIG. 1D provides a side view of the exemplary tie stay clip shown in FIG. 1A when pressure is applied along arrows A.
Figure 1E:
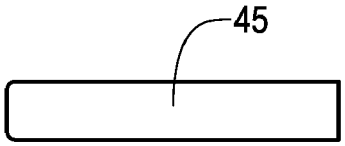
FIG. 1E provides a top view of an exemplary attachment member 45 suitable for attaching to first outermost surface portion 43 shown in FIG. 1B.
Figure 1F:
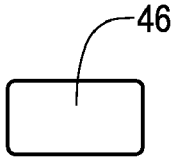
FIG. 1F provides a top view of an exemplary attachment member 46 suitable for attaching to first outermost surface portion 44 shown in FIG. 1B.
Figure 1G:
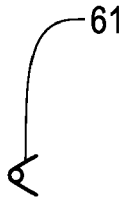
FIG. 1G provides a side view of an exemplary spring member 61 suitable for use in the exemplary tie stay clip shown in FIG. 1A.

FIG. 1D provides a side view of exemplary tie stay clip 10 when pressure is applied along arrows A. Applying pressure onto at least one of first member first end 14 of first member 11 and second member first end 16 of second member 12 causes inner surface 42 of first member second end 15 to separate from inner surface 43 of second member second end 17 so as to form a gap 48 therebetween. As shown in FIG. 1D, inner surface 42 of first member second end 15 and inner surface 43 of second member second end 17 each comprises teeth 69 extending along inner surfaces 42 and 43. It should be noted that in other embodiments, only one of inner surfaces 42 and 43 comprise teeth 69, and still in other embodiments, inner surfaces 42 and 43 do not have any teeth extending therefrom (i.e., inner surfaces 42 and 43 are substantially smooth).

Although FIGS. 1A and 1D depict exemplary tie stay clip 10 as having teeth 69 are optional, and when present, may extend along an entire length of (i) inner surface 42, (ii) inner surface 43, or (iii) both (i) and (ii). It should be further noted that, when present, teeth 69 may extend along less than the entire length of (i) inner surface 42, (ii) inner surface 43, or (iii) both (i) and (ii). In other words, optional teeth 69 may extend along any portion of the length of (i) inner surface 42, (ii) inner surface 43, or (iii) both (i) and (ii).

The present invention is further directed to methods of making tie stay clips. In one exemplary embodiment, the method of making a tie stay clip comprises forming a first member having a first member first end and a first member second end; forming a second member having a second member first end and a second member second end; positioning a spring member between the first and second members; and pivotably connecting the first member to the second member along a length of the first member between the first member first and second ends, wherein the spring member is operatively adapted to apply a spring pressure onto the first and second members so as to force an inner surface of the first member second end toward an inner surface of the second member second end.

In this exemplary method of making a tie stay clip, each of the forming steps may comprise any thermoforming step (e.g., a molding step such as an injection molding step, or a die casting step) in which a material, such as a polymeric material or a, metal is molded or die cast into a desired shape. The exemplary method of making a tie stay clip may further comprise one or more of the following steps: forming one or more attachment members (e.g., via a molding step or a die casting step); attaching one or more attachment members to one or more outer surfaces of the tie stay clip; printing indicia onto one or more outer surfaces of the tie stay clip; and altering one or more outer surfaces of the tie stay clip to provide valleys, peaks or both therein.

The present invention is further directed to methods of using the above-described tie stay clips. In one exemplary embodiment, the method of using a tie stay clip comprises clamping a rear portion of a tie to a front portion of a tie via the tie stay clip so that a portion of a front surface of the rear portion of a tie is adjacent to a portion of a rear surface of the front portion of the tie. FIGS. 2A-3C depict exemplary uses of the disclosed tie stay clips.

Figure 2B:
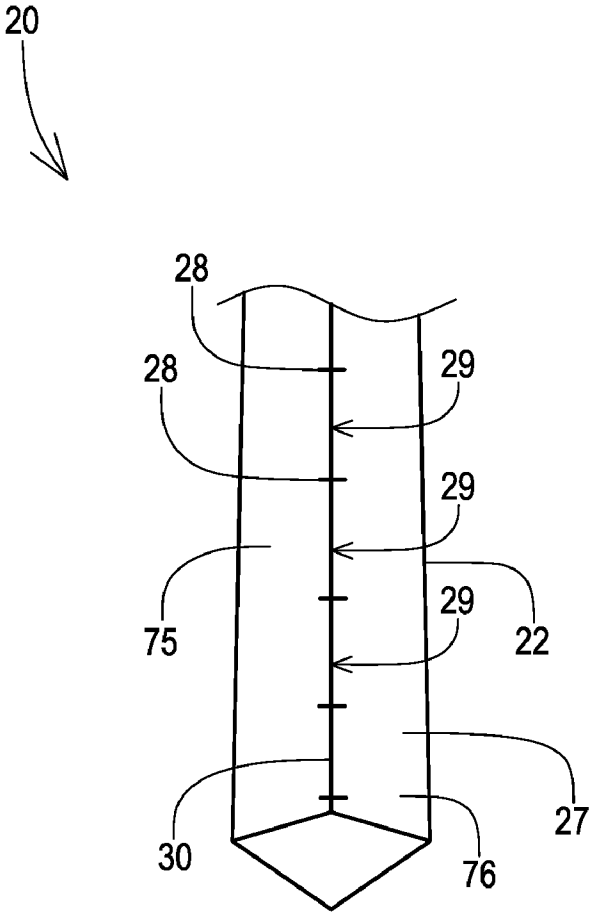
FIG. 2B provides a view of a rear surface of a rear portion of the exemplary tie shown in FIG. 2A.
Figure 2A:
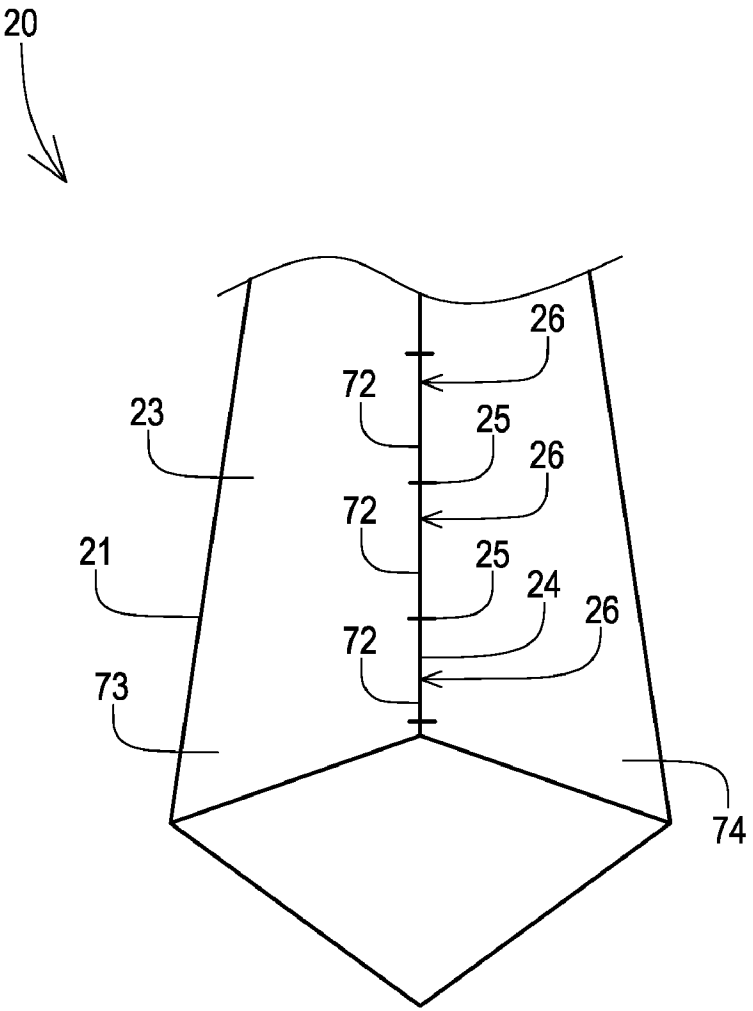
FIG. 2A provides a view of a rear surface of a front portion of an exemplary tie suitable for use with the exemplary tie stay clip shown in FIG. 1A.

FIG. 2A provides a view of a rear surface 23 of a front portion 21 of an exemplary tie 20 suitable for use with exemplary tie stay clip 10. As shown in FIG. 2A, exemplary tie 20 comprises front portion 21 having rear surface 23. As used herein, the phrase "front portion of a tie" is used to describe a viewable portion of a tie once the tie is "tied" around a person's neck. The "front portion of a tie" is the part of the tie that is positioned further away from the chest of the person wearing the tie.

Along rear surface 23 of front portion 21 of exemplary tie 20 lies a vertically extending seam 24, stitches 25 spaced along seam 24, openings 26 positioned between adjacent stitches 25, and vertically extending seam portions 72 extending between adjacent stitches 25 and representing a portion of an outer periphery of each opening 26. Stitches 25 are operatively adapted to attach a left-hand vertically extending front portion 73 of exemplary tie 20 to a righthand vertically extending front portion 74 of exemplary tie 20.

FIG. 2B provides a view of a rear surface 27 of a rear portion 22 of exemplary tie 20. As shown in FIG. 2B, exemplary tie 20 comprises rear portion 22 having rear surface 27. As used herein, the phrase "rear portion of a tie" is used to describe a portion of a tie that is typically not viewable once the tie is "tied" around a person's neck. The "rear portion of a tie" is a "tail" portion of the tie that is positioned closest to the chest of the person wearing the tie.

Along rear surface 27 of rear portion 22 of exemplary tie 20 lies a vertically extending seam 30, stitches 28 spaced along seam 30, and openings 29 positioned between adjacent stitches 28. Stitches 28 are operatively adapted to attach a left-hand vertically extending rear portion 75 of exemplary tie 20 to a righthand vertically extending rear portion 76 of exemplary tie 20. (Typically, left-hand vertically extending rear portion 75 of exemplary tie 20 is continuous with left-hand vertically extending front portion 73 shown in FIG. 2A, while righthand vertically extending rear portion 76 of exemplary tie 20 is continuous with righthand vertically extending front portion 74 of exemplary tie 20 shown in FIG. 2A.)

Figure 3A:
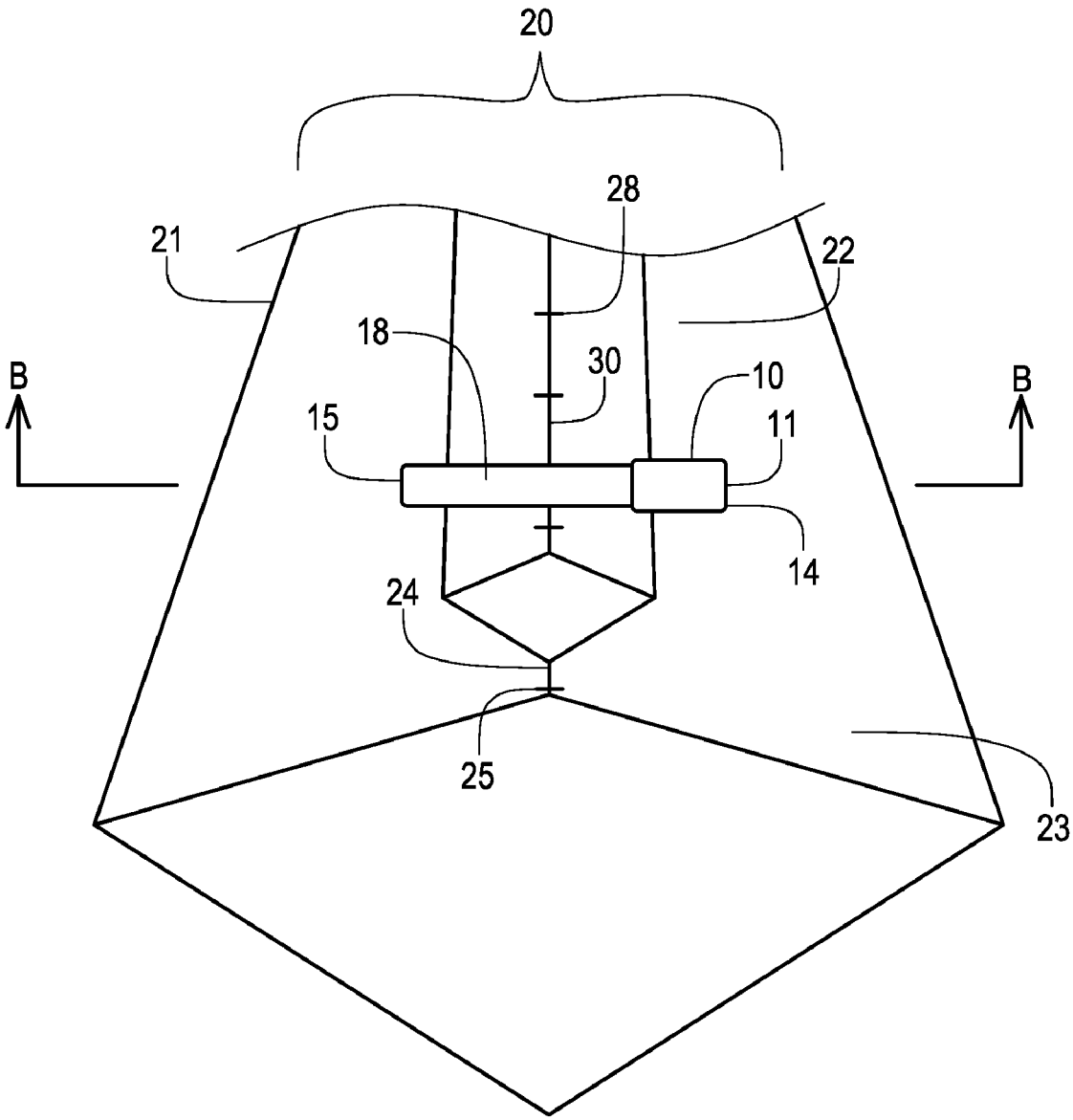
FIG. 3A provides a view of the exemplary tie stay clip shown in FIG. 1A clamping a portion of the rear portion of the exemplary tie shown in FIG. 2B to a portion of the front portion of the exemplary tie shown in FIG. 2A.

FIG. 3A provides a view of exemplary tie stay clip 10 clamping a portion of rear portion 22 of exemplary tie 20 to a portion of front portion 21 of exemplary tie 20. As shown in FIG. 3A, rear portion 22 of exemplary tie 20 is positioned along rear surface 23 of front portion 21 of exemplary tie 20. Exemplary tie stay clip 10 clamps a portion of rear portion 22 to rear surface 23 of front portion 21. Although FIG. 3A shows first member 11 of exemplary tie stay clip 10 as being closest to a person's chest (e.g., next to a person's shirt), it should be understood that exemplary tie stay clip 10 could be used to clamp a portion of rear portion 22 to rear surface 23 of front portion 21 wherein second member 12 of exemplary tie stay clip 10 is closest to the person's chest (e.g., next to the person's shirt).

Figure 3B:
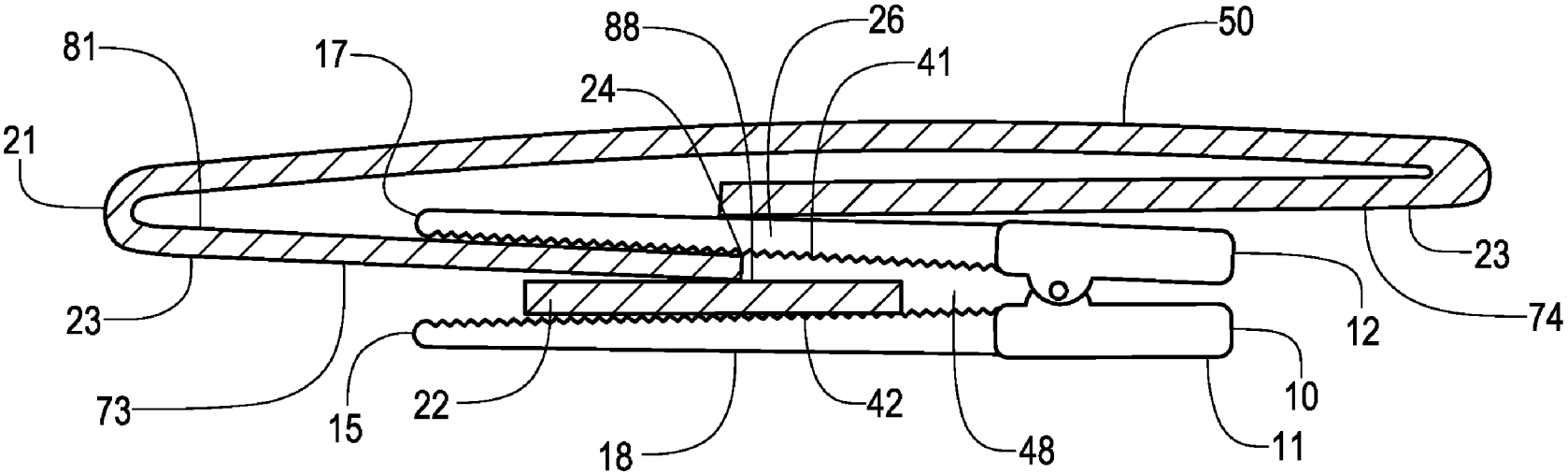
FIG. 3B provides a cross-sectional view of the exemplary tie stay clip, the rear portion of the exemplary tie, and the front portion of the exemplary tie as shown along line B-B in FIG. 3A.

FIG. 3B provides a cross-sectional view of exemplary tie stay clip 10, rear portion 22 of exemplary tie 20, and front portion 21 of exemplary tie 20 as shown along line B-B (i.e., going into the page) in FIG. 3A. As shown in FIG. 3B, exemplary tie stay clip 10 clamps onto (i) a portion of rear portion 22 and (ii) a portion of front portion 21. In particular, inner surface 42 of first member 11 is in contact with a portion of rear surface 27 of rear portion 22, while inner surface 41 of second member 12 is in contact with an interior surface 81 of front portion 21 opposite rear surface 23 of front portion 21. As shown in FIG. 3B, second member second end 17 of exemplary tie stay clip 10 extends into opening 26 between left-hand vertically extending front portion 73 and righthand vertically extending front portion 74 of exemplary tie 20. Further, exemplary tie stay clip 10 is positioned completely behind a front surface 50 (i.e., the viewable surface) of front portion 21 of exemplary tie 20.

It should be further noted that although FIG. 3A depicts front portion 21 of exemplary tie 20 as having openings 26 such that exemplary tie stay clip 10 clamps onto left-hand vertically extending front portion 73 of exemplary tie 20, methods of using exemplary tie stay clip 10 also encompass methods wherein exemplary tie stay clip 10 clamps onto right-hand vertically extending front portion 74 of exemplary tie 20 instead of left-hand vertically extending front portion 73 (i.e., second ends 15 and 17 of exemplary tie stay clip 10 are positioned on a right-hand side of the rear surface 23 of exemplary tie 20 while first ends 14 and 16 of exemplary tie stay clip 10 are positioned on a left-hand side of the rear surface 23 of exemplary tie 20).

Figure 3C:
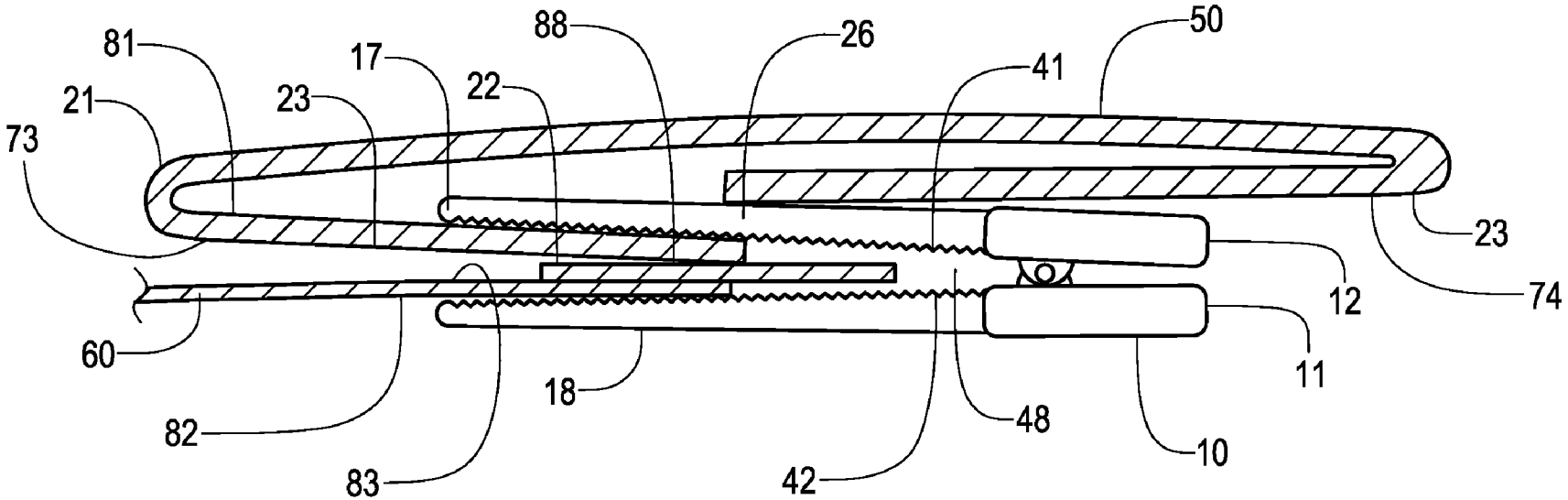
FIG. 3C provides a cross-sectional view of an exemplary tie stay clip, a rear portion of the exemplary tie, a front portion of the exemplary tie, and a portion of a shirt clamped within the exemplary tie stay clip shown in FIG. 1A.

In an alternative method of using a tie stay clip, the tie stay clip may further clamp onto a portion of a shirt positioned beneath the rear portion of a tie as shown in FIG. 3C. As shown in FIG. 3C, exemplary tie stay clip 10 clamps onto (i) a portion of a shirt 60, (ii) a portion of rear portion 22, and (iii) a portion of front portion 21. In particular, inner surface 42 of first member 11 is in contact with a portion of an interior surface 82 of shirt 60; inner surface 41 of second member 12 is in contact with interior surface 81 of front portion 21 opposite rear surface 23 of front portion 21; and rear portion 22 is sandwiched between an exterior surface 83 of shirt 60 and rear surface 23 of front portion 21. As shown in FIG. 3C, second member second end 17 of exemplary tie stay clip 10 extends into opening 26 between left-hand vertically extending front portion 73 and righthand vertically extending front portion 74 of exemplary tie 20. Further, exemplary tie stay clip 10 is positioned completely behind a front surface 50 (i.e., the viewable surface) of front portion 21 of exemplary tie 20.

In the above-described alternative method, it should be noted that the tie stay clip may clamp onto any portion of the shirt positioned beneath the rear portion of a tie. For example, for relatively tall tie wearers, the tie stay clip may need to be positioned closer to the neck region due to a relatively short length of the rear portion of the tie. For other tie wearers, the tie stay clip may be positioned a maximum distance from the neck region (e.g., at the end of vertically extending seam 24) due to a relatively long length of the rear portion of the tie or at any position between the tie knot and the end of the tie along vertically extending seam 24.

As discussed above, the method of using a tie stay clip may comprise clamping a rear portion of a tie (e.g., rear portion 22) to a front portion of a tie (e.g., front portion 21) via the tie stay clip so that a portion of a front surface of the rear portion of a tie (e.g., front surface 88 shown in FIGS. 3B-3C) is adjacent to a portion of a rear surface of the front portion of the tie (e.g., rear surface 23). As described above, methods of using a tie stay clip of the present invention may utilize a tie stay clip having an uppermost outer major surface and a lowermost outer major surface, and comprising (i) a first member forming the uppermost outer major surface and having a first member first end and a first member second end opposite the first member first end; (ii) a second member pivotably connected to the first member along a length of the first member between the first member first and second ends, the second member forming the lowermost outer major surface and having a second member first end and a second member second end opposite the second member first end; and (iii) a spring member positioned between the first and second members, the spring member being operatively adapted to apply a spring pressure onto the first and second members so as to force an inner surface of the first member second end toward an inner surface of the second member second end.

In a further exemplary embodiment, the method of using a tie stay clip may comprise a method of securing a rear portion of a tie to a rear surface of a front portion of a tie, wherein the method comprises (1) providing a tie stay clip having an uppermost outer major surface and a lowermost outer major surface, wherein the tie stay clip comprises (i) a first member forming the uppermost outer major surface and having a first member first end and a first member second end opposite the first member first end, (ii) a second member pivotably connected to the first member along a length of the first member between the first member first and second ends, the second member forming the lowermost outer major surface and having a second member first end and a second member second end opposite the second member first end, and (iii) a spring member positioned between the first and second members, the spring member being operatively adapted to apply a spring pressure onto the first and second members so as to force an inner surface of the first member second end toward an inner surface of the second member second end; (2) applying pressure onto at least one of the first member first end and the second member first end so as to separate the inner surface of the first member second end from the inner surface of the second member second end and form a gap therebetween; (3) positioning (i) the rear portion of the tie and (ii) a vertically extending seam portion of the front portion of the tie within the gap; and (4) releasing the pressure on the first member first end or the second member second end so as to allow the inner surface of the first member second end and the inner surface of the second member second end to move towards one another and clamp therebetween (i) a portion of the rear portion of the tie and (ii) a portion of the vertically extending seam portion of the front portion of the tie. Desirably, a front surface of the rear portion of the tie and a rear surface of the front portion of the tie are adjacent to one another within the gap of the clamped tie stay clip.

The clamping step in the above exemplary methods of using a tie stay clip may comprise (1) applying pressure onto at least one of the first member first end and the second member first end so as to separate the inner surface of the first member second end from the inner surface of the second member second end and form a gap therebetween; (2) positioning (i) the rear portion of the tie and (ii) a vertically extending seam portion of the front portion of the tie within the gap; and (3) releasing the pressure on the first member first end or the second member second end so as to allow the inner surface of the first member second end and the inner surface of the second member second end to move towards one another and clamp therebetween (i) a portion of the rear portion of the tie and (ii) a portion of the vertically extending seam portion of the front portion of the tie.

The positioning step in the above exemplary methods of using a tie stay clip may further comprises (1) selecting a vertically extending seam portion of the front portion of the tie located between two separate stitches operatively adapted to attach a left-hand vertically extending front portion of the tie to a righthand vertically extending front portion of the tie;

and (2) extending the first member second end or the second member second end of the tie stay clip between the two separate stitches so that the inner surface of the first member second end or the inner surface of the second member second end abuts an interior surface of the vertically extending seam portion of the front portion of the tie. In addition, the positioning step in the above exemplary methods of using a tie stay clip may further comprise positioning (i) the rear portion of the tie between (ii) the vertically extending seam portion of the front portion of the tie and (iii) a vertically extending seam portion of a shirt within the gap.

The releasing step in the above exemplary methods of using a tie stay clip may result in (1) a portion of the vertically extending seam portion of the front portion of the tie, (2) a portion of the rear portion of the tie, and (3) a portion of the vertically extending seam portion of the shirt being clamped between the inner surface of the first member second end and the inner surface of the second member second end.

The present invention is further directed to a combination of a tie and the disclosed tie stay clip. In one exemplary embodiment, the combination comprises a tie and a tie stay clip, wherein the tie stay clip comprises (i) a first member forming an uppermost outer major surface of said tie stay clip and having a first member first end and a first member second end, (ii) a second member pivotably connected to said first member along a length of said first member between said first member first and second ends, said second member forming a lowermost outer major surface of said tie stay clip and having a second member first end and a second member second end, and (iii) a spring member positioned between said first and second members, said spring member being operatively adapted to apply a spring pressure onto said first and second members so as to force an inner surface of said first member second end toward an inner surface of said second member second end.

The tie stay clip of the combination may further comprise at least one of the following features:

(I) a first outermost surface portion of the uppermost and/or lowermost outer major surface extending from (i) a location proximate a connection point between the first member and the second member to (ii) a tip of the first member second end, wherein the first outermost surface portion comprises (1) indicia (e.g., printed text or symbols), (2) valleys therein, (3) peaks thereon, or (4) any combination of (1) to (3) as described above;

(II) a second outermost surface portion of the uppermost and/or lowermost outer major surface extending from (i) a location proximate a connection point between the first member and the second member to (ii) a tip of the first member first end, wherein the first outermost surface portion comprises (1) indicia (e.g., printed text or symbols), (2) valleys therein, (3) peaks thereon, or (4) any combination of (1) to (3) as described above;

(III) one or more attachment members sized to fit within an outer periphery of the first outermost surface portion and/or the second outermost surface portion, wherein the one or more attachment members are attachable to the first outermost surface portion or the second outermost surface portion;

(IV) one or more attachment members that are temporarily attachable to the first outermost surface portion or the second outermost surface portion via a temporary bond (e.g., magnetism); and (V) one or more attachment members are permanently attached to the first outermost surface portion or the second outermost surface portion via an adhesive or mechanical bond.

In one exemplary embodiment, the combination comprises a tie and a tie stay clip, wherein the tie stay clip consists of the first member, the second member, and the spring member. In another exemplary embodiment, the combination comprises a tie and a tie stay clip, wherein the tie stay clip consists of the first member, the second member, the spring member, and one or more attachment members. In yet another exemplary embodiment, the combination comprises a tie and a tie stay clip, wherein the tie stay clip consists of the first member, the second member, the spring member, one or more attachment members, and an adhesive or mechanical bond (i.e., to attach the one or more attachment members to one or more outer surfaces of the tie stay clip).

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

A tie stay clip as shown in FIG. 1A was formed by thermoforming each of first and second tie members (e.g., first and second tie members 11 and 12) in separate die casting steps using a gold composition. The first and second tie members were joined to one another via a torsion spring (e.g., spring member 61). The resulting tie stay clip had the following dimensions:

overall length=2.125 inches overall height at first end (e.g., first ends 14 and 16)=0.125 inches overall height at second end (e.g., second ends 15 and 17)=0.5 inches overall width=0.375 inches.

EXAMPLE 2

A tie stay clip as shown in FIG. 1A was formed using the method steps and materials as disclosed in Example 1. Following the die casting steps, outermost surfaces of each of first and second tie members (e.g., outermost surfaces 18 and 19 of first and second tie members 11 and 12) were etched to form peaks and valleys in each outer surface. The resulting tie stay clip had similar dimensions as in Example 1.

EXAMPLE 3

A tie stay clip as shown in FIG. 1A was formed using the method steps and materials as disclosed in Example 1. In addition, separate first and second attachment members (e.g., attachment members 45 and 46) were formed from silver using die casting steps. The resulting first and second attachment members were adhesively bonded to outermost surface portions of the first member (e.g., first outermost surface portion 43 and second outermost surface portion 44). The resulting tie stay clip had similar dimensions as in Example 1.

EXAMPLE 4

A tie stay clip as shown in FIG. 1A was formed by thermoforming each of first and second tie members (e.g., first and second tie members 11 and 12) in separate injection molding steps using a polyvinyl chloride composition. The first and second tie members were joined to one another via a torsion spring (e.g., spring member 61). In addition, separate nickel first and second attachment members (e.g., attachment members 45 and 46) were formed using die casting steps. The resulting first and second attachment members were adhesively bonded to outermost surface portions of the first member (e.g., first outermost surface portion 43 and second outermost surface portion 44). The resulting tie stay clip had similar dimensions as in Example 1.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of using a tie stay clip, said method comprising:

clamping a rear portion of a tie to a front portion of a tie via the tie stay clip so that a portion of a front surface of the rear portion of the tie is temporarily secured to and held adjacent to a portion of a rear surface of the front portion of the tie, wherein the tie stay clip has an uppermost outer major surface and a lowermost outer major surface, and comprises:

a first member forming the uppermost outer major surface and having a first member first end and a first member second end opposite the first member first end;

a second member pivotably connected to the first member along a length of the first member between the first member first and second ends, the second member forming the lowermost outer major surface and having a second member first end and a second member second end opposite the second member first end, and a spring member positioned between the first and second members, the spring member being operatively adapted to apply a spring pressure onto the first and second members so as to force an inner surface of the first member second end toward an inner surface of the second member second end wherein said clamping step comprises:

applying pressure onto at least one of the first member first end and the second member first end so as to separate the inner surface of the first member second end from the inner surface of the second member second end and form a gap therebetween;

positioning (i) the rear portion of the tie and (ii) a vertically extending seam portion of the front portion of the tie within the gap by:

selecting a vertically extending seam portion of the front portion of the tie located between two separate stitches operatively adapted to attach a left-hand vertically extending front portion of the tie to a righthand vertically extending front portion of the tie; and extending the first member second end or the second member second end of the tie stay clip between the two separate stitches so that the inner surface of the first member second end or the inner surface of the second member second end abuts an interior surface of the vertically extending seam portion of the front portion of the tie; and releasing the pressure on the first member first end or the second member second end so as to allow the inner surface of the first member second end and the inner surface of the second member second end to move towards one another and clamp therebetween (i) a portion of the rear portion of the tie and (ii) a portion of the vertically extending seam portion of the front portion of the tie.

2. The method of claim 1, wherein said positioning step further comprises:

positioning (i) the rear portion of the tie between (ii) the vertically extending seam portion of the front portion of the tie and (iii) a vertically extending seam portion of a shirt within the gap; and said releasing step results in (1) a portion of the vertically extending seam portion of the front portion of the tie, (2) a portion of the rear portion of the tie, and (3) a portion of the vertically extending seam portion of the shirt being clamped between the inner surface of the first member second end and the inner surface of the second member second end.

3. A method of securing a rear portion of a tie to a rear surface of a front portion of a tie, said method comprising:

providing a tie stay clip having an uppermost outer major surface and a lowermost outer major surface, wherein the tie stay clip comprises:

a first member forming the uppermost outer major surface and having a first member first end and a first member second end opposite the first member first end;

a second member pivotably connected to the first member along a length of the first member between the first member first and second ends, the second member forming the lowermost outer major surface and having a second member first end and a second member second end opposite the second member first end, and a spring member positioned between the first and second members, the spring member being operatively adapted to apply a spring pressure onto the first and second members so as to force an inner surface of the first member second end toward an inner surface of the second member second end;

applying pressure onto at least one of the first member first end and the second member first end so as to separate the inner surface of the first member second end from the inner surface of the second member second end and form a gap therebetween;

positioning (i) the rear portion of the tie and (ii) a vertically extending seam portion of the front portion of the tie within the gap;

selecting a vertically extending seam portion of the front portion of the tie located between two separate stitches operatively adapted to attach a left-hand vertically extending front portion of the tie to a righthand vertically extending front portion of the tie;

extending the first member second end or the second member second end of the tie stay clip between the two separate stitches so that the inner surface of the first member second end or the inner surface of the second member second end abuts an interior surface of the vertically extending seam portion of the front portion of the tie; and releasing the pressure on the first member first end or the second member second end so as to allow the inner surface of the first member second end and the inner surface of the second member second end to move towards one another and clamp therebetween (i) a portion of the rear portion of the tie and (ii) a portion of the vertically extending seam portion of the front portion of the tie so as to temporarily secure the rear portion of the tie to the rear surface of the front portion of the tie.

4. The method of claim 3, wherein said positioning step further comprises:

positioning (i) the rear portion of the tie between (ii) the vertically extending seam portion of the front portion of the tie and (iii) a vertically extending seam portion of a shirt within the gap; and said releasing step results in (1) a portion of the vertically extending seam portion of the front portion of the tie, (2) a portion of the rear portion of the tie, and (3) a portion of the vertically extending seam portion of the shirt being clamped between the inner surface of the first member second end and the inner surface of the second member second end.

5. In combination a tie and a tie stay clip, said tie stay clip comprising:

a first member forming an uppermost outer major surface of said tie stay clip and having a first member first end and a first member second end;

a second member pivotably connected to said first member along a length of said first member between said first member first and second ends, said second member forming a lowermost outer major surface of said tie stay clip and having a second member first end and a second member second end; and a spring member positioned between said first and second members, said spring member being operatively adapted to apply a spring pressure onto said first and second members so as to force an inner surface of said first member second end toward an inner surface of said second member second end;

wherein said first member second end or said second member second end of said tie stay clip extends between two separate stitches of said tie so that said inner surface of said first member second end or said inner surface of said second member second end abuts an interior surface of a vertically extending seam portion of a front portion of said tie.

6. The combination of claim 5, wherein at least one of (i) said inner surface of said first member second end and (ii) said inner surface of said second member second end comprises teeth extending along said inner surface.

7. The combination of claim 6, wherein each of (i) said inner surface of said first member second end and (ii) said inner surface of said second member second end comprises teeth extending along said inner surfaces.

8. The combination of claim 5, wherein said tie stay clip further comprises (1) a first outermost surface portion extending along said uppermost outer major surface from (i) a location proximate a connection point between said first member and said second member to (ii) a tip of said first member second end, (2) a second outermost surface portion extending along said uppermost outer major surface from (i) a location proximate a connection point between said first member and said second member to (ii) a tip of said first member first end, and (3) one or more attachment members sized to fit within an outer periphery of said first outermost surface portion or said second outermost surface portion, said one or more attachment members being attachable to said first outermost surface portion or said second outermost surface portion.

9. The combination of claim 8, wherein said one or more attachment members are temporarily attachable to said first outermost surface portion or said second outermost surface portion via magnetism.

10. The combination of claim 8, wherein said one or more attachment members are permanently attached to said first outermost surface portion or said second outermost surface portion via an adhesive or mechanical bond.

11. The combination of claim 10, wherein said tie stay clip consists of said first member, said second member, said spring member, said one or more attachment members, and said adhesive or mechanical bond.

12. The combination of claim 8, wherein said tie stay clip consists of said first member, said second member, said spring member, and said one or more attachment members.

13. The combination of claim 5, wherein said tie stay clip consists of said first member, said second member, and said spring member.

14. The combination of claim 5, wherein (i) a rear portion of the tie, and (ii) the vertically extending seam portion of the front portion of the tie are positioned between said inner surface of said first member second end and said inner surface of said second member second end.

15. The combination of claim 5, further comprising a shirt, wherein (i) a rear portion of the tie, (ii) the vertically extending seam portion of the front portion of the tie, and (iii) a vertically extending seam portion of the shirt are positioned between said inner surface of said first member second end and said inner surface of said second member second end.

* * * * *